United States Patent [19]

Whitaker, Jr.

[11] 4,119,199

[45] Oct. 10, 1978

[54] WEAPON SAFETY RECEPTACLE

[76] Inventor: Johnny B. Whitaker, Jr., 504 Lawndale La., Montgomery, Ala. 36109

[21] Appl. No.: 838,577

[22] Filed: Oct. 3, 1977

[51] Int. Cl.[2] ..... B65D 45/22; B65D 85/00

[52] U.S. Cl. ..... 206/317; 220/326; 220/331

[58] Field of Search ..... 206/317; 220/326, 331; 224/1 R

[56] References Cited

U.S. PATENT DOCUMENTS

| | | | |
|---|---|---|---|
| 2,573,548 | 10/1951 | Cunningham | 220/375 X |
| 2,684,176 | 7/1954 | Lehr | 220/326 |
| 2,697,539 | 12/1954 | Warner | 220/326 X |
| 3,465,467 | 9/1969 | Allen | 220/326 X |
| 3,468,427 | 9/1969 | Leslie | 206/317 X |

*Primary Examiner*—Steven E. Lipman
*Attorney, Agent, or Firm*—Woodford R. Thompson, Jr.

[57] ABSTRACT

A weapon safety receptacle embodies a housing section having an upstanding rear wall connected at its lower end to a forwardly extending wall which is connected to an upstanding front wall that terminates below the upper end of the rear wall to define an access opening between the upper edges of the front and rear walls. A cover section has a top wall connected to a depending rear wall which engages a recess in the upper rear portion of the rear wall of the housing section. A depending front wall of the cover section extends alongside the outer surface of and terminates below the upper edge of the front wall of the housing section. A resilient member connects the cover section to the housing section and urges the cover section toward and into engagement with the housing section.

8 Claims, 3 Drawing Figures

FIG 1
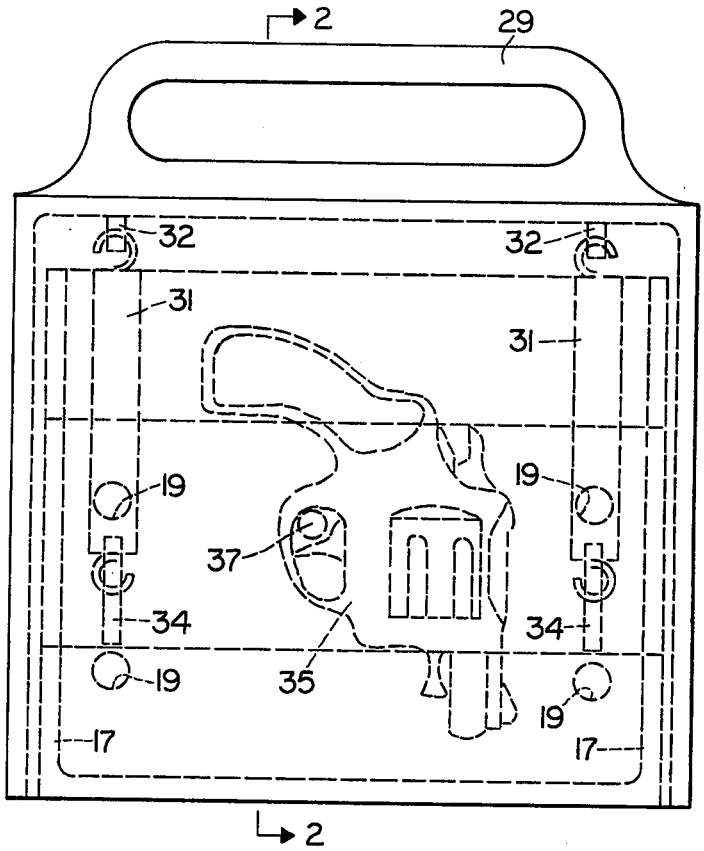
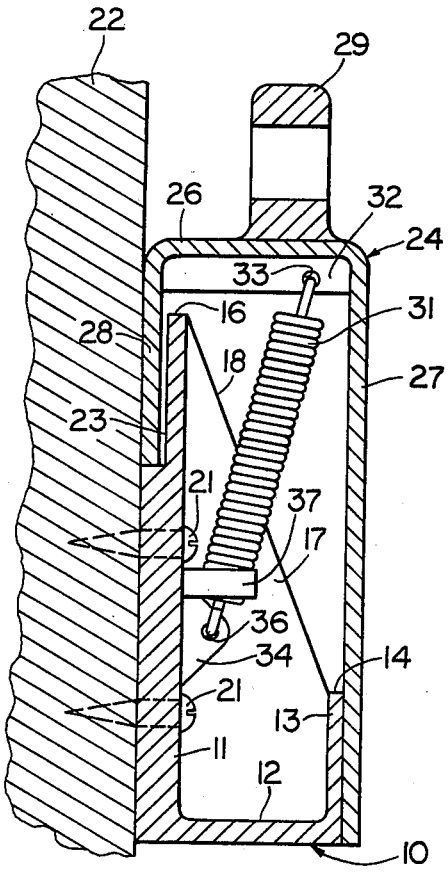
FIG 2
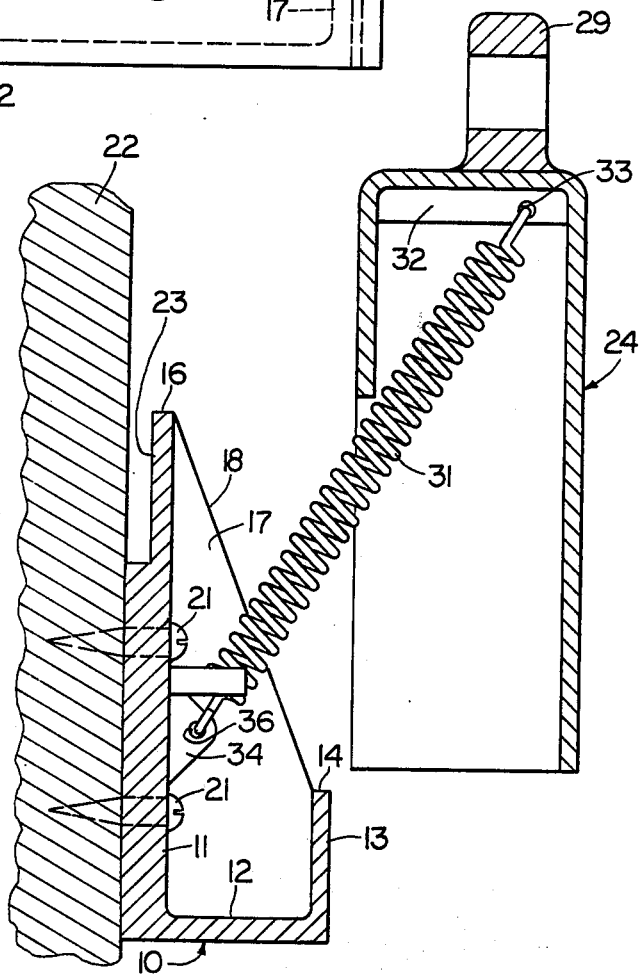
FIG 3

WEAPON SAFETY RECEPTACLE

BACKGROUND OF THE INVENTION

This invention relates to a weapon safety receptacle and more particularly to such a receptacle which is particularly adapted for retaining hand guns and the like out of reach of small children.

While many safety devices have been proposed for fire arms and the like, such devices have complicated locking mechanisms associated therewith whereby the gun cannot be easily and quickly removed. Also, such devices are complicated in structure whereby they are expensive to produce.

SUMMARY OF THE INVENTION

In accordance with my invention, I provide a weapon safety receptacle which not only prevents a child from accidentally finding a weapon but also prevents the child from opening the receptacle in the event he attenpts to do so. At the same time, my improved weapon safety receptacle places the weapon whereby it can be easily found in the dark by an adult and then easily and quickly removed from the receptacle. My improved weapon safety receptacle comprises a housing section having an upstanding rear wall connected at its lower end to a forwardly extending wall which in turn is connected to an upstanding front wall which terminates at an elevation below the upper end of the rear wall to define an access opening between the upper edges of the front and rear walls for passing a weapon, such as a hand gun. Means is carried by the inner surface of the inner wall for retaining at least one weapon in place within the housing. A cover section having a top wall connected to depending front and rear walls is connected to the housing section by at least one resilient member which urges the cover section toward and into engagement with the housing section so that the cover section remains in position to close the access opening until the cover section is pulled away from the housing section with sufficient force to overcome the force exerted by the resilient member. The cover section is provided with a depending front wall which extends alongside the outer surface of and terminates below the upper edge of the upstanding rear wall of the housing section.

DESCRIPTION OF THE DRAWING

A weapon safety receptacle embodying features of my invention is illustrated in the accompanying drawing, forming a part of this application, in which:

FIG. 1 is a front elevational view of the receptacle having a hand gun retained therein, the hand gun being shown in dotted lines;

FIG. 2 is a sectional view taken generally along the line 2—2 of FIG. 1, the hand gun being omitted for the sake of clarity; and FIG. 3 is a view corresponding to FIG. 2 but showing the cover section pulled away from the housing section whereby a weapon may be inserted into or removed from the housing section.

DETAILED DESCRIPTION

Referring now to the drawing for a better understanding of my invention, I show a housing section 10 having an upstanding rear wall 11 connected at its lower end to a laterally and forwardly extending bottom wall 12. The forward end of the bottom wall is connected to an upstanding front wall 13. The upper edge 14 of the front wall 13 terminates at an elevation below the upper edge 16 of the upstanding rear wall 11. The housing section 10 is provided with upstanding side walls 17. As shown in FIGS. 2 and 3, the upper edge 18 of each side wall 17 extends from the upper edge 16 of the upstanding rear wall 11 to the upper edge 14 of the upstanding front wall 13.

Suitable openings 19 are provided in the upstanding rear wall 11 for receiving screw-like members 21 for securing the upstanding rear wall 11 to a supporting structure 22, such as the wall or door of a closet. As shown in FIGS. 2 and 3, a recess 23 is provided in the upper rear portion of the upstanding rear wall 11. That is, the upper rear portion of the upstanding rear wall 11 is cut away to provide the recess 23 between the supporting structure 22 and the upper rear portion of the rear wall 11 while the lower portion of the upstanding rear wall 11 is secured to the supporting structure 22 by the screws 21.

The access opening defined between the upper edges 14 and 16 of the walls 13 and 11 is closed by a cover section 24, as shown in FIG. 2. The cover section comprises a top wall 26 which is connected to a depending front wall 27 and a depending rear wall 28. The depending front wall is adapted to extend alongside the outer surface of and terminate below the upper edge 14 of the upstanding front wall 13. The depending rear wall 28 is of a length to extend into the recess 23 in the upper rear portion of the upstanding rear wall 11, as shown in FIG. 2. That is, the depending rear wall 28 is of a length to engage the bottom of the recess 23, as shown in FIG. 2 when the cover section 24 is in place on the housing section 10 to thus limit downward movement of the cover section 24 relative to the housing section 10. A suitable handle member 29 is carried by the top of the cover section 24 whereby the cover section 24 may be moved selectively to the position shown in FIG. 2 and the position shown in FIG. 3.

As shown in FIGS. 2 and 3, the cover section 24 is connected to the housing section 10 by resilient members, such as tension springs 31 whereby the cover section 24 is urged toward and into engagement with the housing section 10 whereby the cover section remains in position to close the access opening between the upper edges of the upstanding walls 13 and 11 until the cover section 24 is pulled away from the housing section with sufficient force to overcome the force exerted by the resilient members 31. To attach the upper end of the spring members 31 to the inner portion of the cover section 24, inwardly projecting connector brackets 32 are carried by the upper portion of the cover section 24. Suitable openings 33 are provided in the connector brackets 32 for receiving the upper ends of the tension spring members 31, as shown. Inwardly projecting connector brackets 34 are carried by the lower inner portion of the upstanding rear wall 11 for attaching the lower ends of the tension springs 31. Suitable openings 36 are provided in the brackets 34 for receiving the lower ends of the tension springs 31, as shown. Preferably, tension springs 31 are attached to opposite sides of the cover member 24 and housing member 10, as shown in FIG. 1, whereby a uniform force is exerted to cause the cover section 24 to remain in the position shown in FIG. 2 upon placing the cover section 24 in the position shown in FIG. 2. A weapon, such as a hand gun 35, indicated in dotted lines in FIG. 1, is retained in place adjacent the inner surface of the rear wall 11 of the housing section 10 by suitable means, such as by providing an inwardly extending pin-like member 37. However, it will be apparent that other suitable means which will become apparent to one skilled in the art may be employed to retain the hand gun 35 in place within the housing section 10, such as by providing a pocket or the like adjacent the inner surface of a upstanding wall 11 of the housing section 10.

From the foregoing description, the operation of my improved weapon safety receptacle will be readily understood. The receptacle is secured in place at a convenient location, such as along the wall of a closet or door by the retaining screws 21. To insert the hand gun 35 into the housing section 10, the cover section 24 is moved away from the housing section as shown in FIG. 3, by grasping the handle 29 and pulling outwardly with a force which overcomes the force exerted by the tension springs 31. With the cover section 24 in the position shown in FIG. 3, the hand gun 35 may be inserted into the housing section 10 or removed therefrom.

From the foregoing, it will be seen that I have devised an improved weapon safety receptacle. By providing means for securing the cover section onto the housing section which may be removed only upon applying a force sufficient to overcome the pressure exerted by the tension springs 31, the cover section cannot be removed by a child. On the other hand, the cover section may be readily removed by an adult by merely grasping the handle 29 and pulling upwardly and outwardly with sufficient force to overcome the force exerted by the spring members 31. Also, by providing the cover member 24 for the housing section 10 and mounting the housing section 10 within a closet or the like, the receptacle is always in easy reach of an adult whereby the weapon may be easily and quickly removed from the receptacle by merely pulling upwardly and outwardly on the handle 29. Furthermore, by concealing the hand gun or other weapon within the housing section 10 and the cover section 24, a child would not accidentally find the weapon due to the fact that the weapon is completely concealed within the confines of the housing section 10 and the cover section 24.

While I have shown my invention in but one form, it will be obvious to those skilled in the art that it is not so limited, but is susceptible of various changes and modifications without departing from the spirit thereof.

What I claim is:

1. A weapon safety receptacle comprising:

(a) a housing section having an upstanding rear wall connected at its lower end to a laterally and forwardly extending bottom wall which is connected at its forward end to an upstanding front wall that terminates at an elevation below the upper end of said rear wall to define an access opening between the upper edge of said front wall and the upper edge of said rear wall, (b) means carried by the inner side of said upstanding rear wall for retaining at least one weapon in place within said housing section, (c) there being a recess in the upper rear portion of said upstanding rear wall, (d) a cover section having a top wall connected to a depending front wall and a depending rear wall with said depending front wall being adapted to extend alongside the outer surface of and terminate below the upper edge of said upstanding front wall and said depending rear wall being adapted to extend into said recess in said upper rear portion of said upstanding rear wall, and (e) at least one resilient member connecting said cover section to said housing section and urging said cover section toward and into engagement with said housing section so that said cover section remains in position to close said access opening until said cover section is pulled away from said housing section with sufficient force to overcome the force exerted by said resilient member.

2. A weapon safety receptacle as defined in claim 1 in which means is provided for securing said upstanding rear wall of said housing section to a supporting structure.

3. A weapon safety receptacle as defined in claim 1 in which side walls are carried by said cover section in position to extend alongside said housing section.

4. A weapon safety receptacle as defined in claim 1 in which a side wall member is carried by each side of said housing section with the upper edge of each said side wall member extending from the upper edge of said upstanding rear wall to the upper edge of said upstanding from wall.

5. A weapon safety receptacle as defined in claim 1 in which said resilient member is a tension spring connected at one end to an inner portion of said cover section and connected at the other end thereof to an inner portion of said housing section.

6. A weapon safety receptacle as defined in claim 5 in which a first inwardly projecting connector bracket is carried by an upper portion of said cover section for attaching said one end of said tension spring thereto and a second inwardly projecting connector bracket is carried by said housing section for attaching said other end off said tension spring thereto.

7. A weapon safety receptacle as defined in claim 5 in which said cover section is connected to said housing section by a pair of said spring tension members with one spring tension member being adjacent one side of said housing section and said cover section and the other spring tension member being adjacent the other said of said housing section and said cover section.

8. A weapon safety receptacle as defined in claim 1 in which a handle member is carried by the upper portion of said cover section.

* * * * *